US005750056A

United States Patent [19]

Pitman et al.

[11] Patent Number: 5,750,056

[45] Date of Patent: May 12, 1998

[54] REMOTELY CONTROLLED PRIMER ACTUATOR FOR POWER EQUIPMENT ENGINES

[75] Inventors: Richard James Pitman, Nashville; Thomas Doyle Baggett, Antioch, both of Tenn.

[73] Assignee: Murray, Inc., Brentwood, Tenn.

[21] Appl. No.: 715,623

[22] Filed: Sep. 18, 1996

[51] Int. Cl.[6] ..... F02M 1/16

[52] U.S. Cl. ..... 261/37; 261/DIG. 8; 123/179.11

[58] Field of Search ..... 261/DIG. 8, 37; 123/179.11

[56] References Cited

U.S. PATENT DOCUMENTS

| | | | |
|---|---|---|---|
| 986,572 | 3/1911 | Ivor | 261/DIG. 8 |
| 1,657,058 | 1/1928 | Ball | 261/DIG. 8 |
| 2,040,945 | 5/1936 | Leuschner | 123/179.11 |
| 2,148,265 | 2/1939 | Goodman et al. | 123/179.11 |
| 2,474,083 | 6/1949 | Zimmerman . | |
| 2,986,135 | 5/1961 | Clark et al. . | |
| 3,451,383 | 6/1969 | Nelson . | |
| 4,362,673 | 12/1982 | Schauer . | |
| 4,390,480 | 6/1983 | Noisier . | |
| 4,394,331 | 7/1983 | Okabe et al. | 261/DIG. 8 |
| 4,408,683 | 10/1983 | Elmy et al. . | |
| 4,455,266 | 6/1984 | Gerhardy | 261/DIG. 8 |
| 4,738,232 | 4/1988 | Scott | 261/DIG. 8 |
| 4,905,641 | 3/1990 | Miller . | |
| 5,058,544 | 10/1991 | Guntly | 261/DIG. 8 |
| 5,195,307 | 3/1993 | Thorud et al. . | |

FOREIGN PATENT DOCUMENTS

| | | | |
|---|---|---|---|
| 0194067 | 11/1984 | Japan | 261/DIG. 8 |
| 4-214955 | 8/1992 | Japan | 261/DIG. 8 |

*Primary Examiner*—Tim R. Miles

*Attorney, Agent, or Firm*—Cushman Darby & Cushman Intellectual Property Group of Pillsbury Madison & Sutro, LLP

[57] ABSTRACT

A throttle-responsive device is provided which includes a lever which is selectively displaced from a remote point so as to actuate the primer bulb of an engine.

3 Claims, 2 Drawing Sheets

REMOTELY CONTROLLED PRIMER ACTUATOR FOR POWER EQUIPMENT ENGINES

BACKGROUND OF THE INVENTION

1. Field of the Invention

The present invention relates to a device for priming a small engine of the type typically used in power equipment, such as lawnmowers.

2. The Prior Art

Two-cycle and four-cycle engines of the type conventionally employed with hand-operated products for lawn and garden or other home uses—for example, lawnmowers, tillers and snow blowers—conventionally are provided with a manual arrangement by which the engine can be primed for starting. More particularly, a rubber "bulb" is repeatedly depressed by the user so as to introduce fuel to the engine's carburetor thereby facilitating its being started.

Large engines have long been supplied with devices by which actuation of the engine's throttle causes additional fuel to be supplied to the engine's carburetor. Examples are disclosed in: U.S. Pat. No. 4,390,480, issued on Jun. 28, 1983; U.S. Pat. No. 4,362,673, issued on Dec. 7, 1982; and U.S. Pat. 2,474,083, issued on Jun. 21, 1949. Each of these patents is directed to an arrangement in which a pump is actuated during acceleration of the engine to supplement the charge of fuel directed to the carburetor.

U.S. Pat. No. 2,986,135, issued on May 30, 1961, discloses an arrangement for priming an internal combustion engine by selectively opening the escape valve of a supplemental source of combustive material—described as a can of ether—so as to introduce this material to the carburetor to facilitate starting the engine.

SUMMARY OF THE INVENTION

The present invention relates to the use of a throttle-responsive device which is secured adjacent the priming "bulb" of a conventional small engine so as to actuate the bulb when the throttle control is positioned in the engine prime position thereby increasing the amount of fuel supplied to the carburetor.

BRIEF DESCRIPTION OF THE DRAWINGS

The invention will be described in further detail by reference to the accompanying drawings wherein.

DETAILED DESCRIPTION OF A PREFERRED EMBODIMENT OF THE INVENTION

Figure 1:
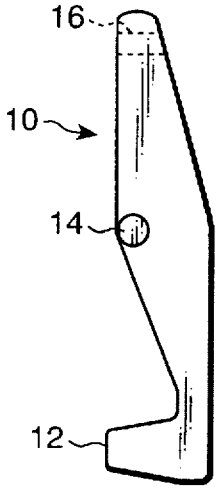
FIG. 1 is a side elevational view of a lever for actuating the primer "bulb" of a conventional small engine.
Figure 2:
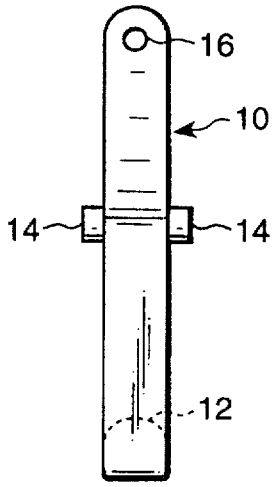
FIG. 2 is a rear elevational view thereof.
Figure 3:
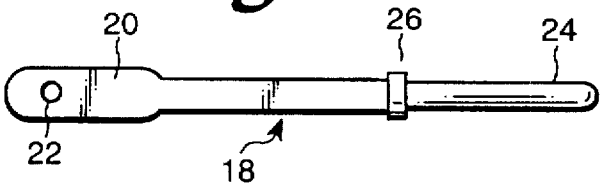
FIG. 3 is a side elevational view of a push rod for displacing the actuating lever shown in FIGS. 1 and 2.

Referring to FIGS. 1 and 2, an actuating lever 10 is illustrated. The lever is an elongated member having a projecting nose 12 formed at one end and provided with axially aligned collars 14 intermediate its ends. The end of the lever opposite nose 12 is provided with an aperture 16 adapted to receive an end of a push rod which is shown in FIG. 3.

The push rod 18 is provided with a flattened end 20 having an aperture 22 for receiving the end of a control cable which hereinafter will be described. The opposite end 24 of the push rod is dimensioned so as to be slidably received within aperture 16 of the actuating lever 10. An annular shoulder 26 is provided on the push rod intermediate its ends.

Figure 4:
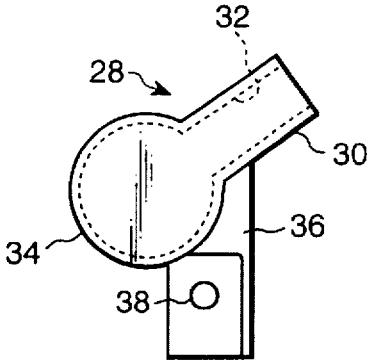
FIG. 4 is a rear elevational view of a bracket for receiving the actuating lever shown in FIGS. 1 and 2.

FIG. 4 illustrates a bracket 28 for receiving lever 10. The bracket—like lever 10 and push rod 18—preferably is a molded plastic piece, although any or all of these components can be formed of metal. The bracket is a hollowed element for receiving, housing and supporting the actuating lever 10. It is provided with a projecting U-shaped end portion 30 having aligned recesses 32 formed in its opposed sidewalls to permit a snap fit with the collars 14 of the actuating lever. The body portion 34 of bracket 28 receives the nose portion 12 of lever 10 (see FIG. 5). The bracket additionally includes a dependent projecting portion 36 provided with an aperture 38 which permits the bracket to be secured to the engine by a screw or other fastener.

Figure 5:
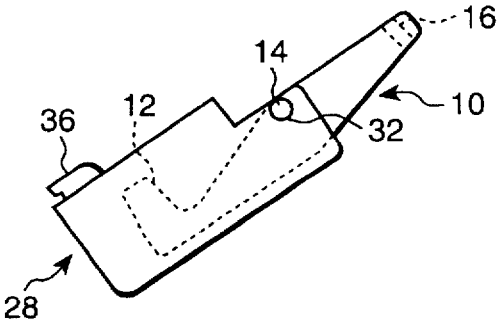
FIG. 5 is a side elevational view illustrating the actuating lever shown in FIGS. 1 and 2 in operative relationship with the bracket shown in FIG. 4.

As can be appreciated from FIG. 5, when the actuating lever 10 is secured within bracket 28 by means of collars 14 being snapped into recesses 32 of the bracket, the lever is pivotally joined to the bracket such that nose 12 can move from a position within the bracket to a position where it projects outwardly from the bracket.

Figure 6:
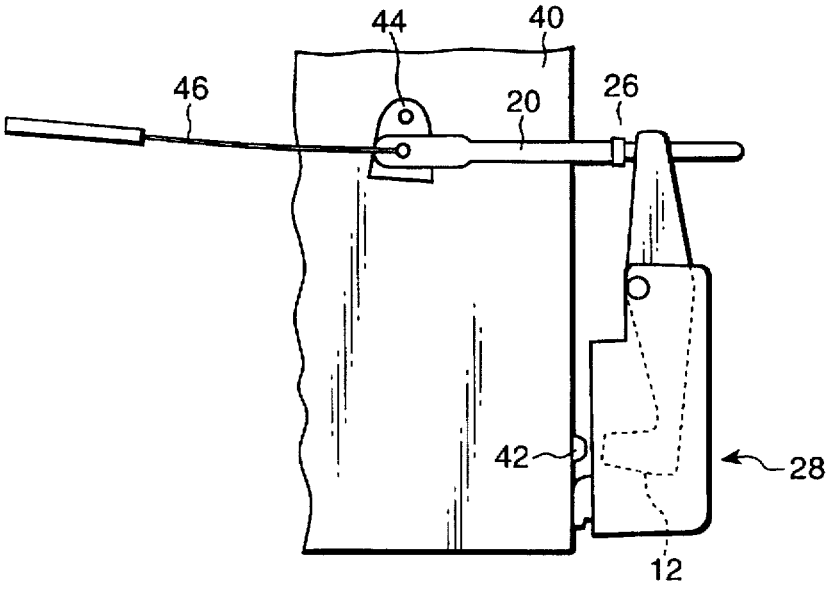
FIG. 6 is a diagrammatic view of the present invention when in an inactive condition.
Figure 7:
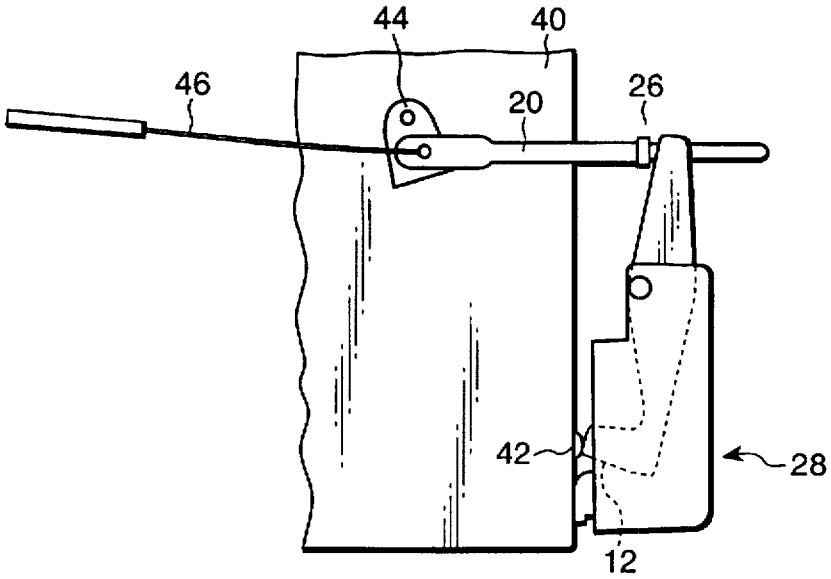
FIG. 7 is a diagrammatic view of the present invention when in an active condition so as to prime the engine.

When bracket 28 is secured to an engine in the manner previously described, and when end 24 of the push rod is inserted through aperture 16 of the actuating lever with the lever pivotally connected to the bracket, the device may be used to prime the engine in the manner now to be described with respect to FIGS. 6 and 7.

For purposes of this discussion of the operation of the invention, it will be assumed that the device is used in connection with a conventional walk-behind lawnmower provided with an engine having a priming bulb. However, it will be apparent that the invention can be employed with any other type of implement having such an engine.

FIGS. 6 and 7 illustrate an engine 40 having a priming bulb 42. Typically, such an engine includes a throttle control lever 44 pivotally joined to the engine so as to control the flow of fuel to the engine. The position of the throttle control lever is determined by a conventional control cable 46 which is selectively displaced by the operator of the implement.

With the elements of the invention assembled as previously described, and with the invention secured to the engine, end 20 of the push rod is pivotally joined to the throttle control lever 44. Preferably, this is accomplished by the end of control cable being passed through aperture 22 of the push rod, as well as through an aperture in the throttle control lever.

It is well understood that with engines used in conventional lawnmowers, the throttle control lever position, as shown in FIG. 6, is the "fast" position used when starting the engine and during mowing. When the motor is started, the throttle plate (not shown) is fully open, but once the engine starts, a governor takes over to position the throttle plate so as to control engine operation in accordance with the load on the engine. Of course, if the control cable is moved during engine operation to displace the throttle control lever towards the position shown in FIG. 7, the engine is slowed to an idling condition. With the engine not operating, the throttle plate remains open regardless of the position of the throttle control lever. This permits fuel to be introduced to the engine when the throttle control lever is moved to the FIG. 7 priming position when the engine is stopped.

When the throttle control lever is in the position shown in FIG. 6, the push rod is located such that its annular shoulder 26 is free of engagement with the actuating lever 10, and nose 12 of the lever is positioned within bracket 28. Thus, the bulb 42 is not engaged by the actuating lever. However, when the control cable is moved to the engine priming position when starting the engine, as shown in FIG. 7, the throttle control lever 44 is pivoted so as to advance the attached push rod thereby causing shoulder 26 to engage the end of lever 10 thereby pivoting it about the common rotational axis formed by collars 14. This in turn causes nose 12 to project beyond the bracket 28 to depress bulb 42 thereby introducing additional fuel to the engine's carburetor so as to facilitate starting of the engine.

The bulb usually is depressed 3–5 times to introduce sufficient fuel for starting. Thus, the throttle control lever must be pivoted in the reverse direction to prepare the mechanism for an additional depression of the bulb. When the throttle control lever is so pivoted through actuation of the control cable 46, the resilient bulb 42 returns to its original position. As it does so, the bulb displaces nose 12 returning it to its normal position within the bracket 28 (FIG. 6).

Repetition of the operations just described permit the bulb to be successively depressed and restored to its original position. Especially when the engine is cold, the bulb must be depressed 3–5 times to introduce sufficient fuel to the carburetor for starting the engine.

As can be appreciated from the foregoing description, the lever 10 is actuated only during an extreme displacement of the throttle control lever by the control plate. Thus, after the engine is started, a wide range of throttle control lever movement is possible without lever 10 being actuated. Thus, normal throttle operation is not interfered with, and a wide range of engine speed can be achieved.

What is claimed is:

1. A combined remotely controlled engine speed and fuel primer actuation arrangement for an engine mounted on a piece of power equipment, said engine including a throttle control lever for controlling engine speed and a primer bulb which, when actuated, introduces fuel to the engine to supplement that normally introduced from a fuel supply, said arrangement comprising:

a single control cable connected between said throttle control lever and a remote location on said piece of power equipment for selectively displacing the throttle control lever; and an actuator selectively connected between the throttle control lever and the primer bulb for actuating the primer bulb in response to displacement of the throttle control lever.

2. An arrangement as set forth in claim 1, wherein said actuator is joined in pivotally movable relationship to said engine.

3. An arrangement as set forth in claim 2 wherein said actuator is selectively connected to the throttle control lever by a push rod extending from the throttle control lever to an end of the actuator.

* * * * *